United States Patent [19]

Bryne

[11] 4,155,449

[45] May 22, 1979

[54] RETURNABLE ENCLOSED BEVERAGE CARRIER WITH IMPROVED TOP PANEL

[75] Inventor: Bruce W. Bryne, West Monroe, La.

[73] Assignee: Olinkraft, Inc., West Monroe, La.

[21] Appl. No.: 887,386

[22] Filed: Mar. 16, 1978

[51] Int. Cl.[2] ..... B65D 65/10

[52] U.S. Cl. ..... 206/427

[58] Field of Search ..... 206/427, 431, 434, 611, 206/634, 628; 229/40

[56] References Cited

U.S. PATENT DOCUMENTS

| | | | |
|---|---|---|---|
| 2,754,047 | 7/1956 | Schmidt et al. | 206/427 |
| 3,346,167 | 10/1967 | Schmidt | 206/427 |
| 3,367,557 | 2/1968 | Farquhar | 229/40 |
| 3,688,972 | 9/1972 | Mahon | 206/427 |
| 3,696,990 | 10/1972 | Dewhurst | 206/427 |
| 3,904,036 | 9/1975 | Forrer | 206/427 |

FOREIGN PATENT DOCUMENTS

| | | | |
|---|---|---|---|
| 807509 | 3/1969 | Canada | 206/434 |

*Primary Examiner*—Herbert F. Ross
*Attorney, Agent, or Firm*—Norvell E. Von Behren

[57] ABSTRACT

A returnable enclosed beverage carrier having an improved top panel is disclosed herein with the beverage carrier being the type comprising a bottom panel, a pair of side panels, a pair of end panels, a top panel and a plurality of locks on the end panels of the package to form an enclosed package around a plurality of beverage containers. The improved top portion comprises a handle opening being formed in the top panel in the central portion thereof and a pair of tear-out portions being formed adjacent to the handle portion to provide access to the interior of the package; the tear-out portions are positioned so that the weight of the beverage carrier and beverage containers is carried to the corners of the package through predetermined portions on the top panel. This allows the tear-out portions to be removed from the top panel without destroying the structural integrity of the package and allows the package to be reused for carrying empty beverage containers back to a retail outlet.

10 Claims, 4 Drawing Figures

RETURNABLE ENCLOSED BEVERAGE CARRIER WITH IMPROVED TOP PANEL

BACKGROUND OF THE INVENTION

This invention relates to beverage carriers and more particularly refers to a new and improved beverage carrier of the returnable enclosed type which may be utilized to carry full beverage containers away from a retail outlet and also to return the empty beverage containers to the retail outlet in the same package.

Beverage carriers of the type utilizing the applicant's invention are generally constructed for use with glass beverage containers such as beer or soft drinks. One way beverage carriers have been designed using prior art techniques for the express purpose of carrying full beverage containers to the home of the user with the carrier being physically destroyed whenever the containers are removed from the package. These types of carriers were popular in times past with the advent of the one-way, no deposit, throw away bottle.

With the recent thrust toward eliminating so many no deposit bottles from the market place for ecology an aesthetic reasons, two-way or returnable deposit type bottles have been coming back into style. In conjunction with this move toward two-way returnable bottles, recent trends seem to indicate that the beverage consumer desires larger size packages containing more bottles than the usual six pack which previously was the standard size package for home consumption. In today's marketplace, the trend appears to be going toward providing beverage carriers having at least twelve bottles contained in the carrier.

With the thrust toward the larger size carriers, the problem is encountered of designing a package having sufficient structural strength and integrity to carry the large number of full bottles of beverage with the package being provided with some way of removing all of the bottles from the package without destroying the package itself. Accordingly, the ultimate purpose of a returnable enclosed beverage carrier is to allow the contents of the package to be removed and still to be able to use the same package for carrying the empty bottles back to the retail outlet.

SUMMARY OF THE INVENTION

In order to provide a package meeting the described criteria, there has been obtained by the subject invention, a new and novel returnable enclosed beverage carrier which may be utilized to carry at least twelve full glass bottles with means being provided on the top of the package for removing all of the glass bottles from the package without destroying the structural integrity of the package. The means for removing the bottles comprises in the preferred embodiment a pair of semicircular tear-out portions being formed on the top panel with the tear-out portions orginating at the junction of the end panels of the package and the top panel and being spaced in a predetermined position from a pair of handle openings formed in the top panel. The spacing of the tear-out portions in relationship to the handle opening provides for predetermined portions or areas of the top panel to be utilized to carry the weight of the beverage carrier and contents whenever the tear-out portions are removed or severed from the top panel.

As a result thereby the structual integrity of the package is retained and the full bottles may be removed from the opening formed by the tear-out portions, and the empty bottles may be reinserted into the package through the same opening with the package being used to carry the empty bottles back to the retail outlet.

Accordingly, it is an object and advantage of the invention to provide a new and improved enclosed beverage carrier having novel tear-out portions positioned in predetermined locations on the top panel so that the contents can be quickly removed from the package without destroying the package.

Another object and advantage of the invention is to provide a new and novel enclosed beverage carrier that may be used for carrying at least twelve bottles and which has novel means formed on the top of the panel for structurally carrying the weight of the package and the bottles in the package.

These and other objects and advantages of the invention will become apparent from a review of the following description of the preferred embodiment and from a study of the drawings described in that preferred embodiment.

DESCRIPTION OF THE PREFERRED EMBODIMENT

Figure 1:
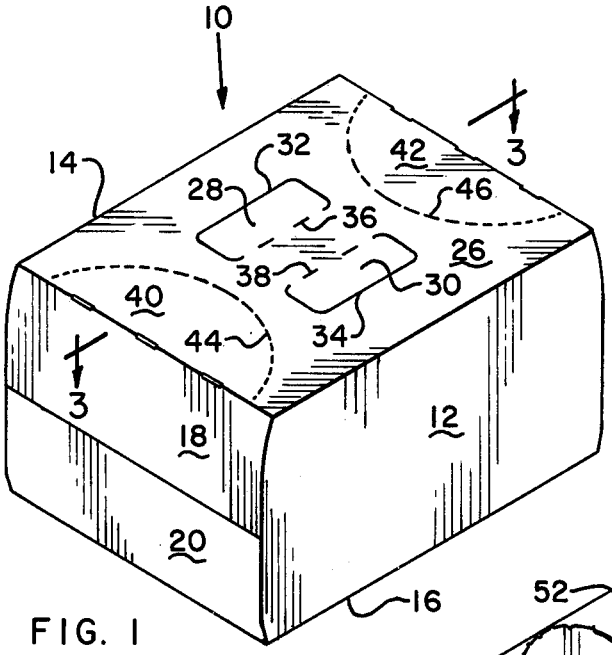
FIG. 1 is a perspective view of the applicant's new and novel enclosed beverage carrier showing the placement of the handle opening and the new and novel tearout portions and their location in respect to the handle opening.

Referring now to the drawings in general and in particular to FIG. 1 of the drawing there is shown a perspective view of a typical returnable enclosed beverage carrier of the type utilizing the applicant's new and improved top panel. The beverage carrier, shown generally by the numeral 10, comprises a pair of side panels 12 and 14 hingedly attached to a bottom panel 16, not shown in the drawing. The carrier 10 also has formed on the ends thereof a plurality of end panels formed by means of two pair of flaps 18 and 20 formed on one end of the package and a pair of flaps 22 and 24 formed on the other end of the package although not shown in FIG. 1 of the drawing. The end panels for the beverage carrier are structurally formed whenever the end flaps 18 and 20 and the end flaps 22 and 24 are locked together either by means of a locking structure or by means of adhesive to form in essence the end panels. Prior to locking the flaps 18 and 20 and the flaps 22 and 24 together, a plurality of bottles are positioned within the beverage carrier and the bottles are separated by interior divider means of various types in order to insure that the adjacent bottles do not touch each other and ultimately break as a result a colliding with one another.

The beverage carrier 10 also comprises a top panel 26 which contains a handle opening formed in the preferred embodiment by a pair of openings formed by die cutting tabs 28 and 30 along die cuts 32 and 34 with the tabs being folded along scorelines 36 and 38.

The top panel 26 also contains a pair of tear-out portions 40 and 42 formed with perforations 44 and 46 formed with a nicked cutting steel rule die.

Figure 2:
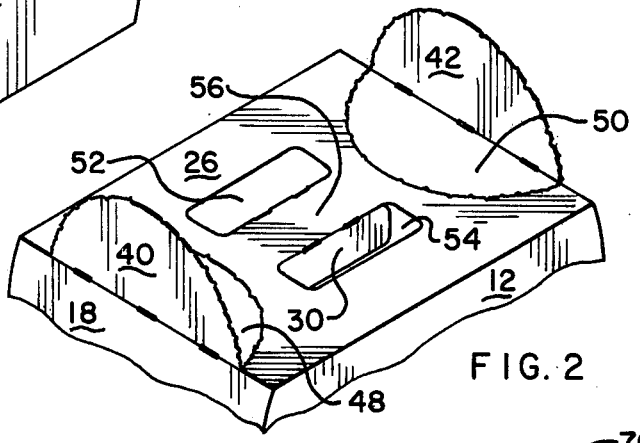
FIG. 2 is a partial perspective view showing the top portion of the applicant's beverage carrier and further showing the novel tear-out portions being severed from the top panel prior to removing the bottles from the carrier.

Referring now to FIG. 2 of the drawing it can be seen how the top panel 26 looks whenever the tear-out portions 40 and 42 have been severed from the top panel in order to remove the bottles contained within the beverage carrier. The tear-out portions 40 and 42, in the preferred embodiment, are formed in a general semicircular configuration and provide a semicircular opening 48 and 50 through which the bottles may be withdrawn from the package. The tabs 28 and 30 are depressed by the purchaser of the package along the scorelines 36 and 38 and are positioned downwardly inside the package to form a pair of openings 52 and 54 allowing the purchaser to carry the package by inserting his fingers in the openings 52 and 54 and lifting the package upon the strap area 56.

Figure 3:
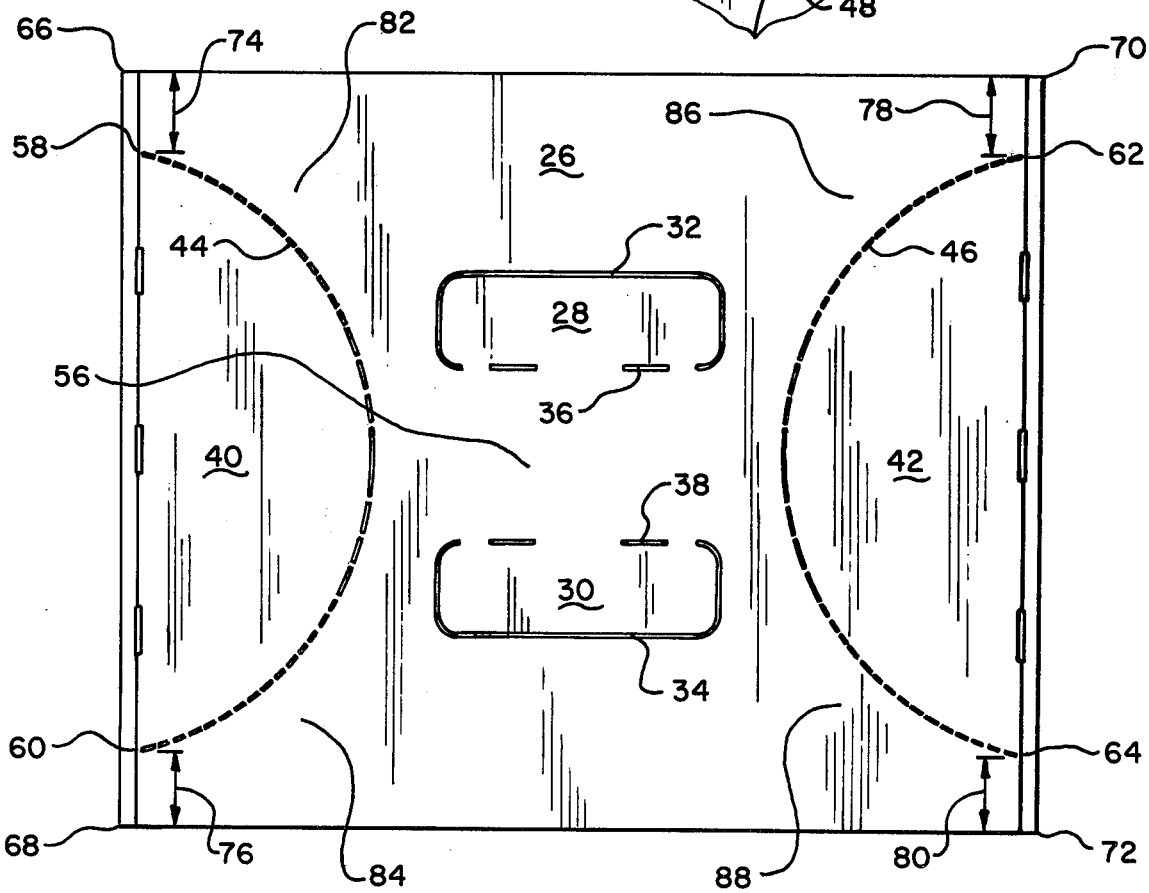
FIG. 3 is a top view, taken along line 3—3 of FIG. 1 showing the relative placement of the tear-out portions in relation to the handle opening and also showing the predetermined portions of the top panel that are utilized to carry the weight of the container and contents of the package.

Referring now to FIG. 3 of the drawing there is shown an enlarged top view of the beverage carrier 10 and there will be described in more detail the novel features of the top panel 26. The tear-out portions 40 and 42 are positioned on the top panel 26 so that they originate at the junction of the end panels and the top panel at the location shown by the numerals 58 and 60 and the numerals 62 and 64. The origination of the semicircular tear-out portions are also spaced a predetermined distance from the upper corners 66, 68, 70 and 72 of the package for the purposes as will be described hereinafter. This predetermined distance, shown by the numerals 74, 76, 78 and 80, is approximately $\frac{7}{8}$ of an inch in the preferred embodiment when the subject invention is used on an enclosed beverage carrier designed for holding at least twelve bottles.

When the semicircular tear-out portions 40 and 42 are positioned thusly, they form predetermined portions 82, 84, 86 and 88 which originate at the handle openings 52 and 54 and terminate at the upper corners 66, 68, 70 and 72. When formed thusly these predetermined portions 82, 84, 86 and 88 carry the weight of the package and the contents contained therein whenever the package is lifted by the purchaser with the weight and stresses in the paperboard being directed to the corners 66, 68, 70 and 72. By placing the tear-out portions 40 and 42 in the predetermined position shown so that the tear-out portions do not extend into the weight carrying area 82, 84, 86 and 88, it can be seen that the tear-out portions 40 and 42 may be severed from the top panel 26 without destroying the structural integrity of the top panel. As a result the package may be utilized for carrying empty bottles back to the retail outlet by positioning the bottles within the package through the openings 48 and 50.

Figure 4:
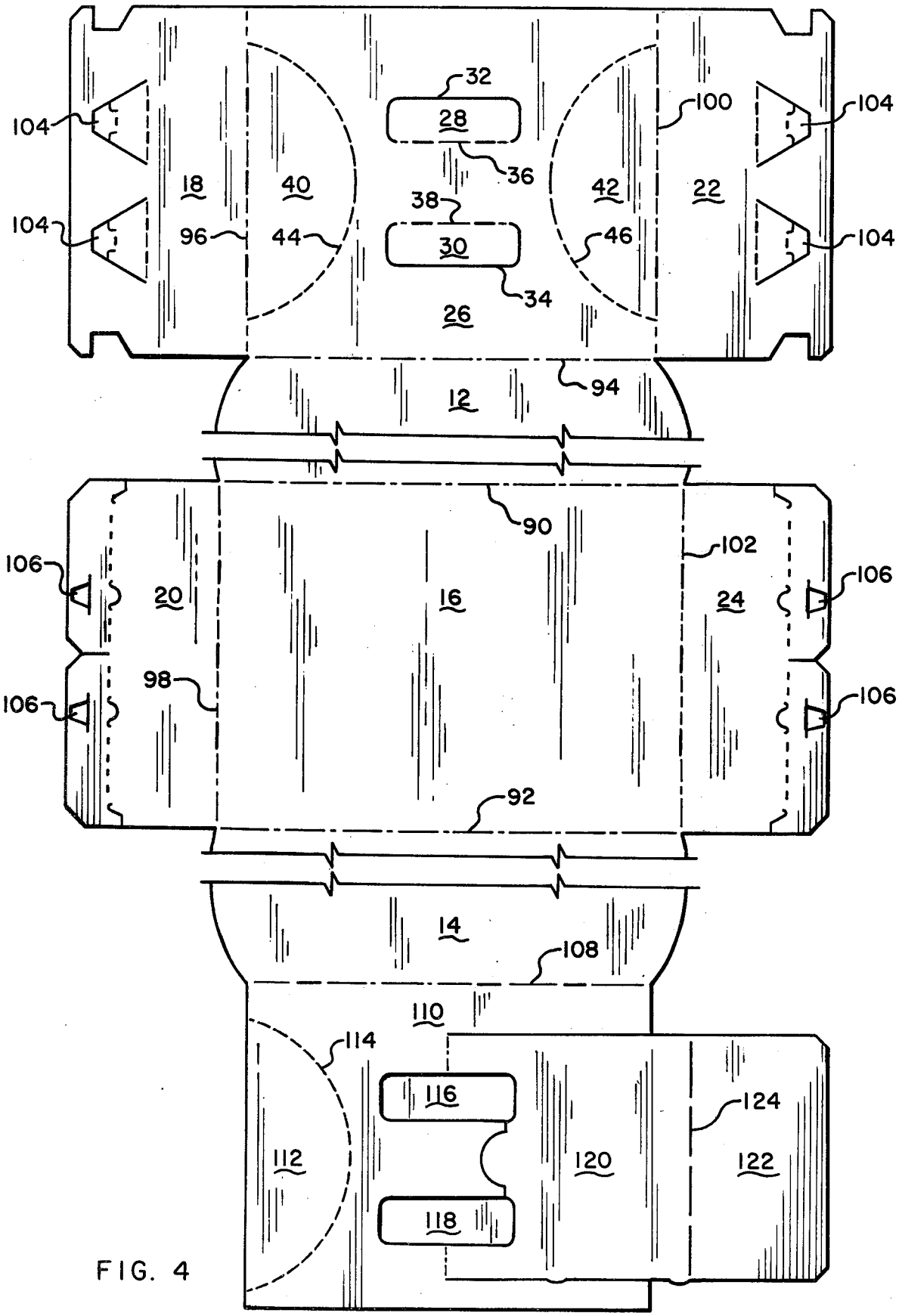
FIG. 4 is a plan view of the production blank of the subject invention prior to its being folded in the usual manner around a plurality of bottles.

Referring now to FIG. 4 of the drawing there is shown a plan view of the production blank of the cartonboard used for forming the beverage carrier 10 which comprises the beforementioned bottom panel 16 which is hingedly attached to the side panels 12 and 14 by means of the scorelines 90 and 92. The top panel 26 is hingedly attached to the side panel 12 by means of the scoreline 94, and the end flaps 18 and 20 are higedly attached respectively to the top panel 26 and the bottom panel 16 by means of the scorelines 96 and 98. In a like manner the flaps 22 and 24 are hingedly connected respectively to the top panel 26 and the bottom panel 16 by means of the scorelines 100 and 102.

The end flaps 18 and 20, as well as the end flaps 22 and 24, have formed thereupon a plurality of locking structures 104 and 106 of the type known in the art and forming no part of the subject invention. It is within the spirit and scope of the invention that the end flaps 18 and 20, as well as the end flaps 22 and 24, could be also glued in place to form the end panels for the beverage carrier by utilizing known adhesives.

Hingedly attached to the side panel 14, by means of the scoreline 108, is an interior top panel 110 which is glued to the exterior top panel 26 in such a manner as to reinforce the top panel 26 and also to join the side panel 14 to the top panel 26. The interior top panel 110 also has formed on one side thereof a semicircular tear-out portion 112 similar in size, shape and position to the tear-out portion 40 and formed thereby by means of the perforated line 114. The interior top panel 110 also has formed in the central portion thereof a pair of handle openings 116 and 118 of the same size, shape and location as the handle openings 52 and 54 formed in the exterior top panel 26.

There is also formed in the interior top panel 110 a central partition structure 120 which is dropped down within the package whenever the bottles are positioned within the package. The central partition structure is then utilized with removable loose divider partitions to totally separate all of the bottles from each other within the package. There is also provided a tab 122 formed by means of the scoreline 124 on the central partition 120 which may be adhesively secured to the bottom panel 16 to add further structural strength to the package.

From the foregoing it can be seen that there has been provided by the subject invention a new and novel enclosed beverage carrier having a new and improved top panel which allows the beverage carrier to be used with returnable bottles presently becoming popular in the marketplace. From a review of the foregoing specification and a study of the drawings, it should become apparent that many changes may be made in the structure of the subject invention and the arrangement of the various parts of the basic structure without departing from the spirit and scope of the invention. For example, the semicircular shape of the tear-out portions 40 and 42 may be varied somewhat from that shown to other shapes as long as the final shape is sufficient to allow all of the bottles contained within the package to be removed from the openings 48 and 50 and without having the handle stresses passed through the tear-out portion which would weaken and destroy the structural integrity of the carrier whenever the carrier is picked up by the purchaser with a full content of bottles contained therein. It is therefore intended that the subject invention is not to be limited to the preferred embodiment shown and desired herein which has been given by way of illustration only.

Having described my invention, I claim:

1. In a returnable enclosed beverage carrier of the type having a bottom panel, a pair of side panels, a pair of end panels, a top panel, the side and end panels along with the top panel forming a plurality of upper corners, and means for locking a portion of the panels together to form an enclosed package around a plurality of beverage containers which may be reused after the containers have been removed, the improvement comprising:

(a) forming the top panel in a one piece construction;

(b) forming a handle opening by means of at least one hinged tab in the top panel in the central portion thereof, the handle opening forming an elongated strap area in the top panel; and (c) forming a pair of hinged tear-out portions adjacent to said handle opening and at least a major portion of the tear-out portions being formed in the top panel, the handle opening and the tear-out portions being hinged on different axes located approximately 90° apart, the tear-out portions serving to provide access to the interior of the package through at least a major portion of the top panel; said tear-out openings being positioned so that predetermined portions of the top panel, originating at said elongated strap area and terminating at the upper corners, do not pass through said tear-out portions thereby allowing the weight of the beverage carrier with its beverage containers to be carried by said elongated strap area and by said predetermined portions and thereby retaining the carrier's structural integrity whenever said tear-out portions are severed from the top panel so that the package may be reused for carrying empty beverage containers back to a retail outlet.

2. The improvement as defined in claim 1 wherein said handle opening in the top panel of the carrier comprises a pair of openings formed adjacent to each other and spaced apart therefrom, said openings being formed by die cutting tabs out of a portion of the top panel.

3. The improvement as defined in claim 1 wherein said tear-out portions comprise a plurality of semicircular shaped portions originating at the junction of the end panels and the top panel.

4. The improvement as defined in claim 3 further comprising said semicircular portions originating at a predetermined distance from the upper corners.

5. The improvement as defined in claim 4 wherein the predetermined distance is approximately $\frac{7}{8}$ of an inch.

6. An improved returnable enclosed beverage carrier of the type that may be utilized to carry full beverage containers from a retail outlet to the consumer's home and thereupon to reuse the beverage carrier for carrying the empty beverage containers back to the retail outlet, comprising:

(a) a bottom panel;

(b) a pair of side panels hingedly attached to opposed sides of said bottom panel;

(c) an interior top panel hingedly attached to one of said pair of side panels;

(d) an exterior one piece top panel hingedly attached to the other of said pair of side panels, said exterior top panel being fixedly attached to said interior top panel;

(e) a pair of end flaps on each end of the carrier hingedly attached to the exterior top panel and to the bottom panel;

(f) means, associated with said pairs of end flaps, for locking said flaps together to form a pair of end panels for the beverage carrier;

(g) interior divider means positioned within the central portion of the enclosed beveragel carrier;

(h) a handle opening formed from at least one hinged tab and formed in the central portion of said top panels, the handle opening forming an elongated strap area in the top panels; and (i) a pair of tear-out portions formed adjacent to said handle opening and at least a major portion of the tear-out portions being formed in the top panel, the handle opening and the tear-out portions being hinged on different axes located approximately 90° apart, the tear-out portions serving to provide access to the interior of the package through at least a major portion of the top panel, said tear-out openings being positioned so that predetermined portions of said top panel, originating at said elongated strap area and terminating at upper corners of the beverage carrier, do not pass through said tear-out portions to thereby allow the weight of the beverage carrier and the beverage containers to be carried by said elongated strap area and by said predetermined portions and to retain the structural integrity of the carrier whenever said tear-out portions are severed from the top panel so that the package may be reused for carrying the empty beverage containers back to a retail outlet.

7. The beverage carrier as defined in claim 6 wherein said handle openings comprise a pair of openings formed adjacent to each other and spaced apart from each other, said pair of openings being formed by die cutting tabs out of a portion of said top panel.

8. The beverage carrier as defined in claim 6 wherein said tear-out portions are formed in a semicircular shape originating at the junction of the end panels and the top panel.

9. The beverage carrier as defined in claim 8 wherein said semicircular portions originate at a predetermined distance from upper corners of the beverage carrier.

10. The beverage carrier as defined in claim 9 wherein said predetermined distance is approximately $\frac{7}{8}$ of an inch.

* * * * *